US008087513B2

(12) United States Patent
Kriesel

(10) Patent No.: US 8,087,513 B2
(45) Date of Patent: Jan. 3, 2012

(54) MUSIC INSTRUMENT CASE WITH INTERCHANGEABLE LIDS

(76) Inventor: Steve Kriesel, Minneapolis, MN (US)

( * ) Notice: Subject to any disclaimer, the term of this patent is extended or adjusted under 35 U.S.C. 154(b) by 0 days.

(21) Appl. No.: 12/722,197

(22) Filed: Mar. 11, 2010

(65) Prior Publication Data

US 2010/0230307 A1 Sep. 16, 2010

Related U.S. Application Data

(60) Provisional application No. 61/159,657, filed on Mar. 12, 2009.

(51) Int. Cl.
*A45C 11/00* (2006.01)
*A45C 7/00* (2006.01)
*A45C 5/14* (2006.01)

(52) U.S. Cl. ..... 206/314; 190/18 A; 190/103

(58) Field of Classification Search ..... 206/14, 206/314; 190/18 A, 102, 108, 111, 103–105
See application file for complete search history.

(56) References Cited

U.S. PATENT DOCUMENTS 4,008,790 A * 2/1977 Eiteljorg, II ..... 190/103
4,427,113 A 1/1984 Wanner
4,433,781 A * 2/1984 Hummel ..... 206/314
4,867,307 A 9/1989 Bovee
5,669,495 A 9/1997 West
5,918,737 A 7/1999 Kwon
6,279,740 B1 8/2001 Dorman
6,283,287 B1 * 9/2001 Carl ..... 206/314
6,330,944 B1 12/2001 DeMichele
6,446,809 B2 9/2002 Flynn
6,471,059 B2 * 10/2002 Purvis ..... 206/459.1
6,502,676 B2 1/2003 Dexheimer
6,662,944 B2 12/2003 Hagemann et al.
6,670,536 B2 * 12/2003 Godin et al. ..... 84/453
6,722,496 B2 4/2004 Gantert
6,945,396 B2 9/2005 Dimbath
7,032,753 B2 * 4/2006 Purvis ..... 206/459.5
7,044,297 B2 * 5/2006 Terrell ..... 190/102
7,090,075 B1 8/2006 Rocha
(Continued)

FOREIGN PATENT DOCUMENTS

DE 20021141 4/2001

*Primary Examiner* — Bryon Gehman
(74) *Attorney, Agent, or Firm* — Larkin Hoffman Daly & Lindgren, Ltd.; Craig J. Lervick

(57) ABSTRACT

A flexible music instrument case uses an interchangeable lid system to allow different types of lids to be attached to a main body depending on the particular needs of the user. The main body of the music case has an internal chamber configured to closely contain and protect the musical instrument or instruments, depending on the particular instruments being carried. The main body is somewhat structured to maintain a container shape, and may include various levels of rigidity. In addition, the main body further has at least one attachment mechanism attached to a portion thereof, to allow an interchangeable lid to be removably attached to the main body. The interchangeable lid has a similar attachment mechanism attached thereto to allow for the removable attachment of various lid elements. The interchangeable lids are configured differently to allow a user to configure the carrying case as necessary, and may include accessory compartments, sheet music pockets, or extended accommodations to allow portions of the musical instruments to extend beyond the open top while also being contained. Additional handles, wheels and straps are also included to increase the ease of use for the musical instrument case.

19 Claims, 6 Drawing Sheets

U.S. PATENT DOCUMENTS

| | | | | |
|---|---|---|---|---|
| 7,240,778 | B2 * | 7/2007 | Duncanson et al. | 190/102 |
| 7,584,847 | B2 * | 9/2009 | Purvis | 206/459.1 |
| 7,712,608 | B2 * | 5/2010 | Leach | 206/314 |
| 2002/0092783 | A1 | 7/2002 | Banner | |
| 2006/0027472 | A1 * | 2/2006 | Gokcen et al. | 206/314 |
| 2008/0060956 | A1 * | 3/2008 | Izen et al. | 206/314 |

* cited by examiner

MUSIC INSTRUMENT CASE WITH INTERCHANGEABLE LIDS

RELATED APPLICATIONS

This application claims the benefit of U.S. Provisional application 61/159,657 entitled "Music Instrument Case With Interchangeable Lid", filed on Mar. 12, 2009.

BACKGROUND OF THE INVENTION

1. Field of the Invention

The present invention relates to protective carrying cases for use in carrying various instruments and products. More specifically, the present invention relates to a carrying case system providing interchangeable components to allow for differing configurations, depending upon the various needs of a user.

2. Background of Invention

The transportation of products and equipment can occasionally be troublesome for certain individuals and organizations. This is specifically true when very expensive equipment is to be transported, such as musical instruments, complex electrical equipment, sporting equipment, etc. As can be anticipated, competing interests are involved when this type of equipment is transported. Naturally, the protection and safekeeping of the devices is important, often due to the cost of the equipment involved. Thus, protective carrying cases are desirable which provide appropriate safekeeping.

In addition to the above mentioned concerns, the actual use of the carrying case is also a consideration. Specifically, the user may have different needs at different times. For example, in some circumstances the user may only need to transport a primary set of articles and in other circumstances, the user may need to transport the primary set of articles along with a number of accessories. In other circumstances, the nature of the items being transported may vary. With these possibilities in mind, it would be beneficial to have a carrying case that has some level of flexibility and the option to be easily reconfigured to meet the user's needs.

In addition to need for flexibility outlined above, the circumstances may also dictate necessary carrying considerations. For example, in certain instances it will be more convenient to simply have a handle on the case, where other instances may be more appropriate for backpack-type straps or shoulder straps. Naturally, the environment will largely dictate the desired carrying options for the user.

SUMMARY OF THE INVENTION

In order to provide a user with multiple options, the present invention includes a carrying case with an interchangeable lid portion. The carrying case includes a main body which may have supporting structures specifically configured for carrying particular items. The main body includes attachment mechanisms to allow for the easy attachment of various lids. The various lids will each have corresponding attachment mechanisms to that attachment is easily achieved. By using the same attachment mechanisms, interchangeability is also achieved.

In one embodiment, the case is specifically configured for holding and carrying various musical instruments and related accessories/materials. The carrying case of this embodiment includes a main body which includes internal structures for the easy holding and protecting the instruments to be carried. This largely involves soft pliable material such as foams and fabric coatings to closely surround and contain the instrument or device being carried. The main body will also include handles and strap structures to easily accommodate the movement and transport of the case.

In this same embodiment, multiple lids are included to meet varying needs. As one example, a simple covering lid is used which primarily acts as a cover for the main body. In another embodiment, the lid will be enlarged and capable of holding additional accessories or materials. In yet a further embodiment, the lid will be configured to accommodate special handling needs for items contained in the main body. For example, the item being carried may need additional space, which could be built into the structure of the lid.

Thus, the user is provided with a system to easily accommodate various needs without the need for multiple cases. In addition, various carrying options are attached to the second case, thus allowing easy transport. For example, backpack straps, handles, shoulder straps are all provided, thus providing many options for the user.

DETAILED DESCRIPTION OF THE INVENTION

Figure 1:
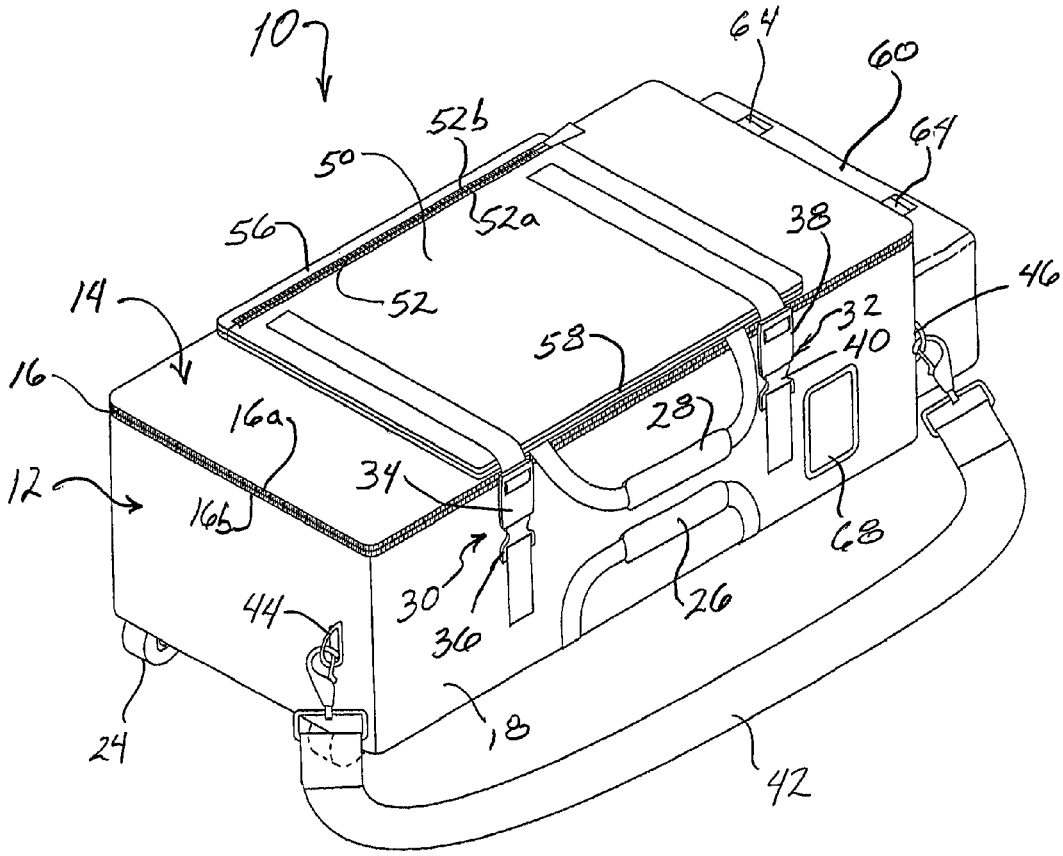
FIG. 1 is a perspective view of an embodiment of a music instrument case with an embodiment for one of the interchangeable lids.
Figure 2:
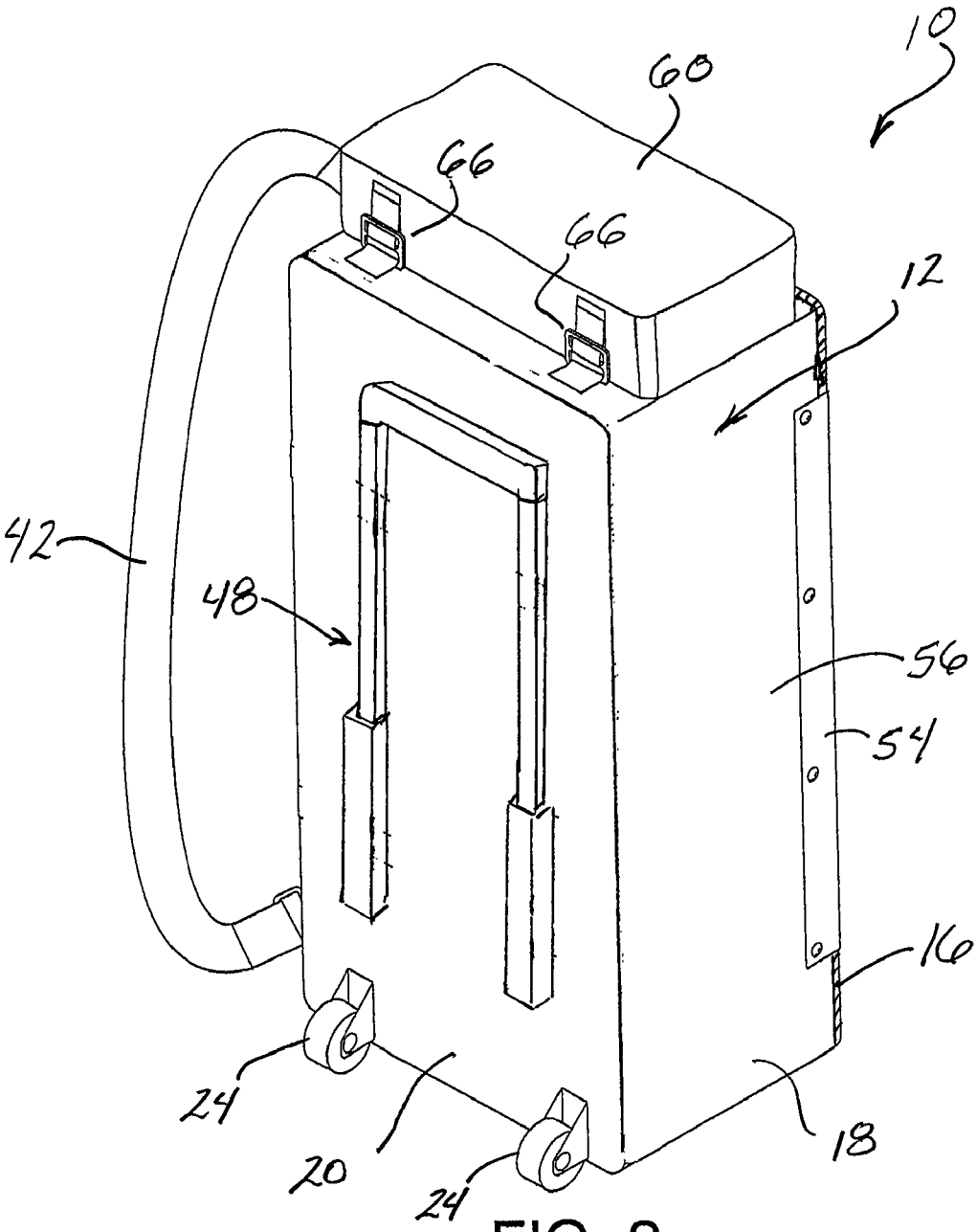
FIG. 2 is another perspective view of the music case of FIG. 1.

Referring now to the drawings, wherein like reference numerals designate identical or corresponding parts throughout the several views, FIG. 1 is a perspective view of an embodiment of a music instrument case designated generally by reference numeral 10. The case 10 includes a body 12 and a plurality of interchangeable lids 14 having different desired features as illustrated in FIGS. 3, 5, 6 and 7. Each of the interchangeable lids 14 is removably attached to the body 12 by an attachment zipper 16 extending around the periphery of the lid 14 and body 12. Each of the interchangeable lids 14 includes one-half of the attachment zipper **16*a* while the body includes the other half of the attachment zipper 16*b***.

Figure 3:
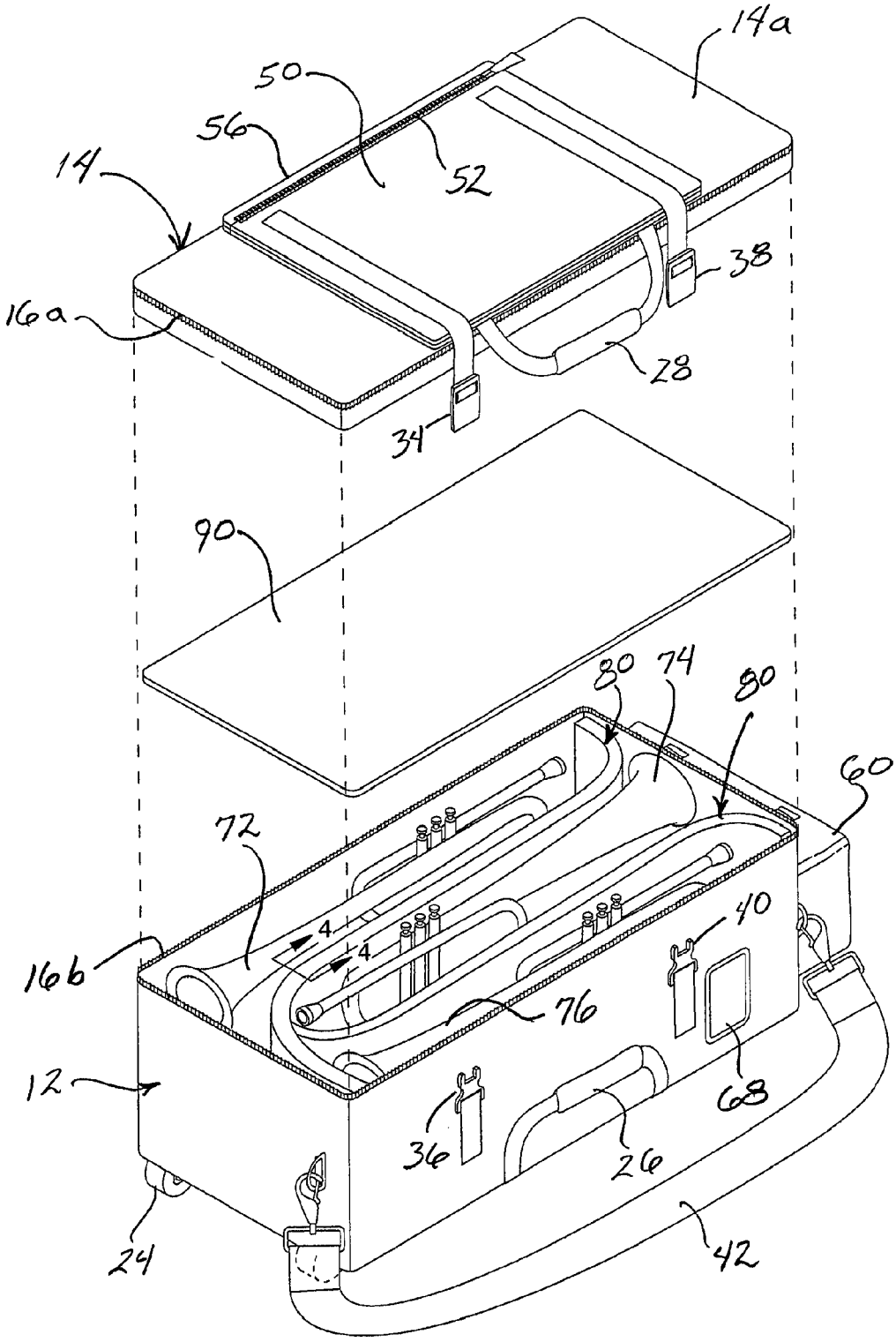
FIG. 3 is an exploded perspective view of the music case of FIG. 1 showing the interchangeable lid removed.

The body 12 is preferably constructed of fiberglass wall members 18 and bottom panel 20. The interior of the wall members 18 and bottom panel 20 are preferably lined with suitable padding and fabric to cushion the instruments disposed therein (FIG. 3). The exterior surface of the wall members 18 and bottom panel 20 are preferably covered by an appropriate wear resistant material.

The case 10 preferably includes wheel assemblies 24 secured to the bottom panel 20. The case 10 also preferably includes a pair of mating handles 26, 28 one secured to the body 12 and one secured to the interchangeable lid 14. Additionally, the case 10 preferably includes two pair of snap-buckles 30, 32. Each of the pair includes mating ends 34, 36 and 38, 40. One of the mating ends 34, 38 of each buckle pair 30, 32 is preferably secured to the interchangeable lid 14 and the other mating ends 36, 40 of each buckle pair 30, 32 is secured to the body 12. The case 10 also preferably includes a shoulder strap 42 removably attachable to D-rings 44, 46 disposed on top and bottom ends of the case 10. The case 10 also preferably includes a collapsible pull handle 48 secured to the exterior of the bottom panel 20, which, in cooperation with the wheels 24 permits the case 10 to be easily pulled or pushed over the ground surface to avoid having to carry the case.

The case 10 also preferably includes a removable music pouch 50. In a preferred embodiment, the music pouch 50 is attached by a zipper 52 to a flexible elongated panel 54 secured to the back wall member 56 of the body 12. One half of the zipper 52*a* is secured to the removable pouch 50 and the other half of the zipper 52*b* is secured to the flexible elongated panel. The music pouch 50 is preferably comprised of a flexible, wear resistant and water resistant material forming an envelope with at least one opening 58 with a zipper or other suitable closure, for stowing sheet music, papers or other items.

The case 10 also preferably includes another storage pouch 60 preferably removably attachable to the top wall member 62 of the body 12 by a plurality of mating snap-buckles 64, 66. Each of the pair of buckles mating ends, one end secured to the removable storage pouch 60 and the other end secured to the top wall member 62. The case also preferably includes an identification window 68 for inserting a card with the owner's name and contact information.

Figure 4:
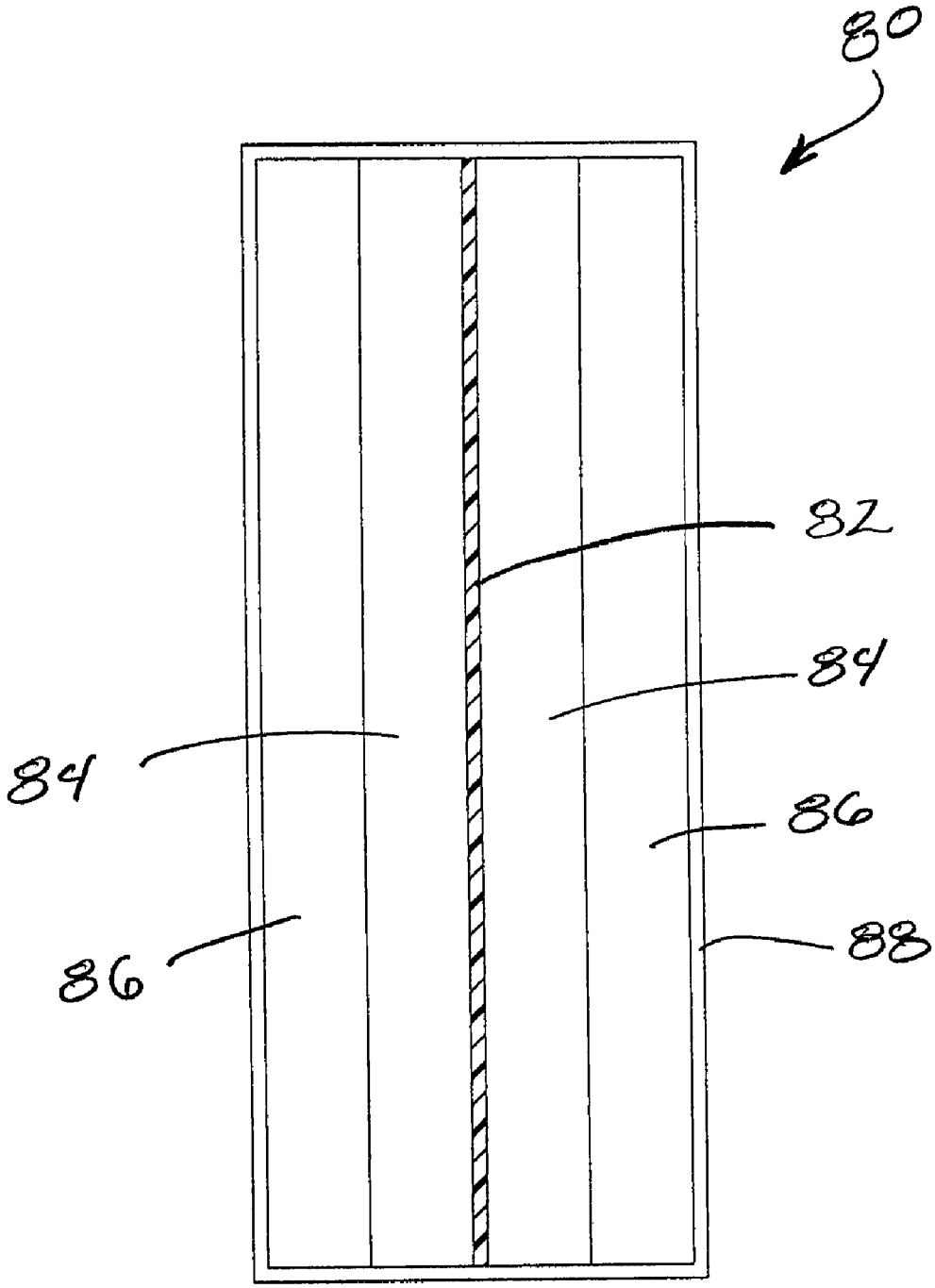
FIG. 4 is a cross-sectional view of the preferred padding construction used in the music case between instruments as viewed along lines 4-4 of FIG. 3.

In FIG. 3, the embodiment of the interchangeable lid 14*a* is simply to serve as a cover to the body 12. In the preferred embodiment the body 12 is sized to preferably receive three trumpets 70, 72, 74 in nested relationship. However, it should be appreciated that the case may be any desired shape or size to receive different instruments and different numbers of instruments. In FIG. 3, a pad 80 is disposed between the adjacent trumpets, 70, 72 and 72, 74. FIG. 4 illustrates the preferred construction of the pad 80 in cross-section. The pad 80 preferably includes an interior resilient panel 82, preferably vinyl or other suitable resilient material. Disposed on each side of the resilient panel 82 is preferably an inner foam layer 84 and an outer foam layer 86. The inner foam layer 84 is preferably a open-cell foam. The outer foam layer is preferably closed-cell foam. A soft, but wear resistant fabric 88 preferably covers the exterior of the pad 80. The sandwich construction allows the pad 80 to be flexible to fit around the musical instruments while at the same time providing a conforming padding with good impact resistance to prevent damage to adjacent instruments during transport and handling of the case 10. An intermediate panel 90 is preferably provided between the body 12 and the lid 14. Like the body walls and base, the intermediate panel 90 is also preferably fiberglass or other suitably rigid but light weight material.

Figure 5:
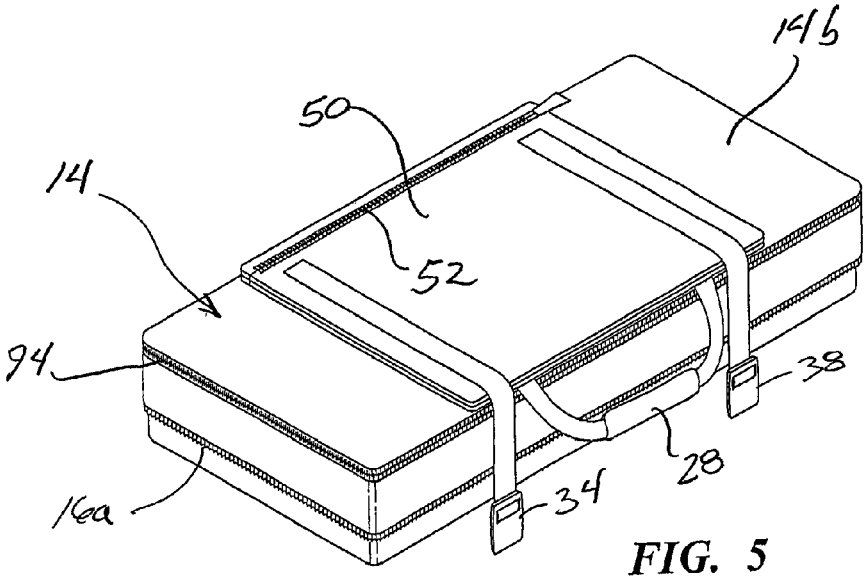
FIG. 5 is a perspective view of another embodiment for one of the interchangeable lids.
Figure 6:
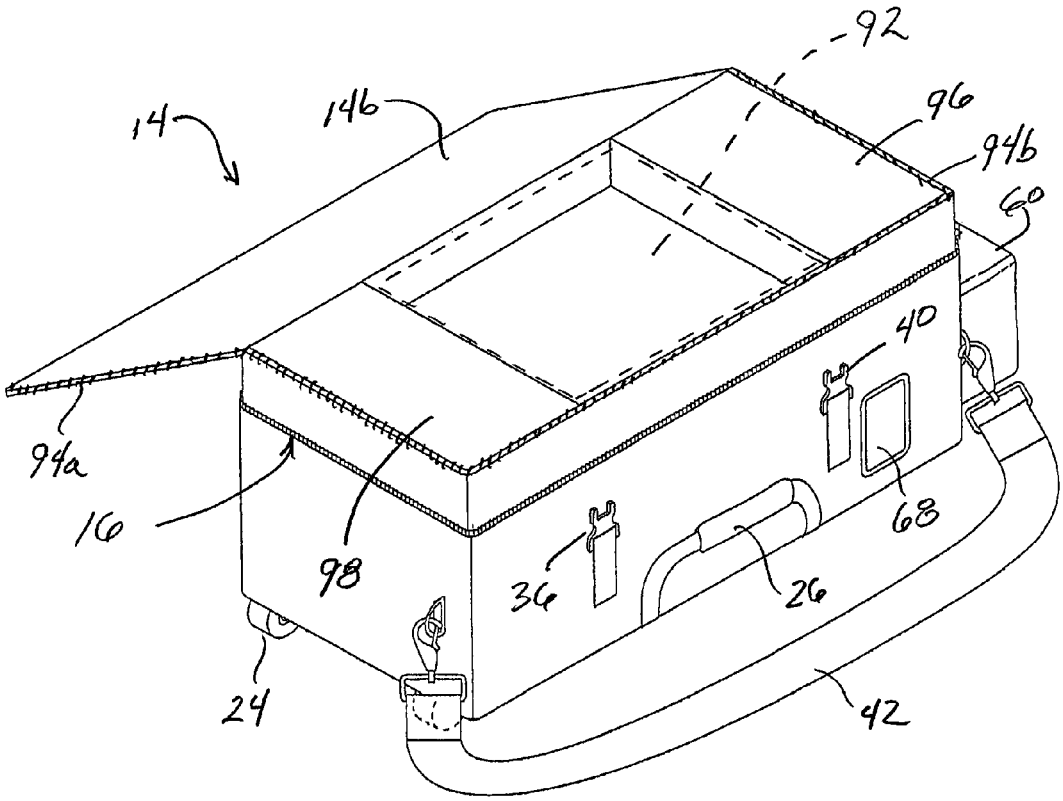
FIG. 6 is a perspective view of the music case of FIG. 1 showing the lid of FIG. 5 attached to the music case and in the open configuration.

FIG. 5 illustrates another embodiment of an interchangeable lid 14 for use with the case 10. In this embodiment, the lid 14*b* is deeper than the previously described lid 14*a* for storing items therein, such as a computer 92 (FIG. 6) or to simply allow more room for other instruments, such as a small flugelhorn. In this embodiment, one half of the attachment zipper 16*a* is still disposed a short distance above the bottom of the bottom periphery of the lid. Thus providing a flange that mates with or is received by the upper periphery of the body 12. A second zipper 94 preferably extends around three sides of the upper periphery of the lid 14*b* to provide access to the items stored therein, such as a computer 92, as illustrated in FIG. 6. As shown in FIG. 6, foam pads 96, 98 of different sizes and configurations may be provided to prevent the items stored within the lid 14*b* from moving during transport and handling.

Figure 7:
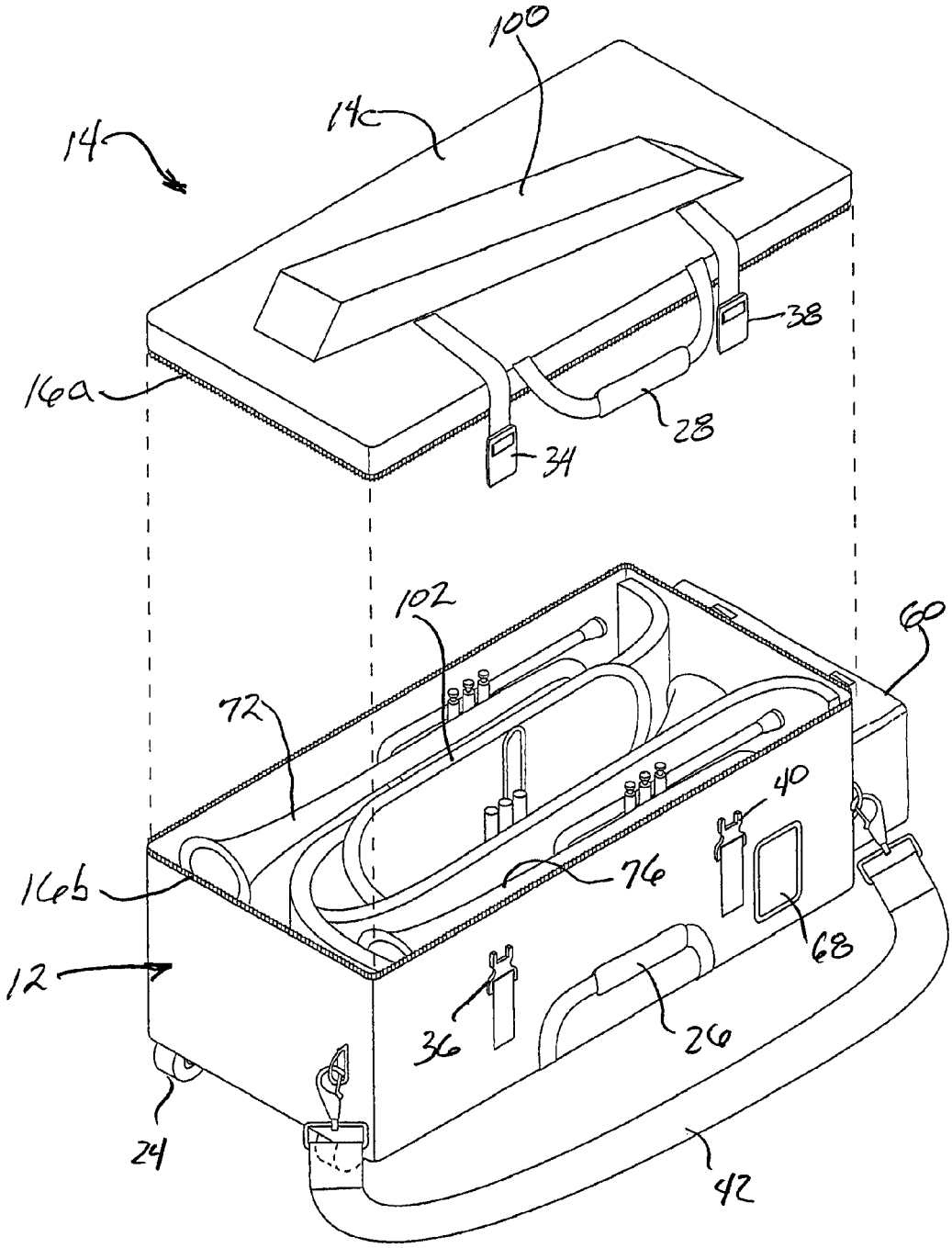
FIG. 7 is an exploded perspective view of the music case of FIG. 1 showing another embodiment for one of the interchangeable lids.

FIG. 7 illustrates another embodiment of an interchangeable lid 14 for use with the case 10. In this embodiment, the lid 14*c* includes a raised portion 100 to receive any instrument components that may protrude above the walls of the body. For example if an instrument is packed in the case which has a depth greater than the walls of the body 12, such as if a large flugelhorn 102 was packed with the two trumpets. The lid 14*c* is preferably constructed of fiberglass or other suitably rigid and lightweight material. The interior surface of the lid is preferably covered with a thin padding layer and fabric, thicker padding may be provided within the interior of the raised portion to more securely hold the protruding element. It should be appreciated that the configuration and position of the raised portion 100 may vary depending on the shape of the protruding element of the instrument to be received.

What is claimed is:

1. A music instrument case for containing and transporting a musical instrument comprising:

a main body having an internal chamber configured to closely contain and protect the musical instrument, the main body further having at least one attachment mechanism coupled thereto; and a set of interchangeable lids, each lid being different and being removably attachable to the main body, each of the interchangeable lids further having at least one attachment mechanism attached thereto, wherein the at least one attachment mechanism of the main body and the at least one attachment mechanism of each interchangeable lid are attachable so as to create the removable attachment capability to allow interchanging of the lids.

2. The music instrument case of claim 1 wherein the main body creates a structured enclosure having a predetermined rigidity configured to surround the musical instrument, the main body having an open top, and wherein the at least one attachment mechanism coupled to the main body is a zipper having a first set of zipper teeth surrounding the open top.

3. The music instrument case of claim 2 wherein the each interchangeable lid is configured to cover the open top and has a second set of zipper teeth on an outer edge thereof aligned to cooperate with the first set of zipper teeth.

4. The music instrument case of claim 3 wherein a said interchangeable lid further comprises an accessory carrying compartment which is accessible from an exterior side of the lid.

5. The music instrument case of claim 3 wherein a said interchangeable lid includes accommodations to allow the musical instrument to extend beyond the open top, wherein the extension beyond the open top is received within the accommodations.

6. The music instrument case of claim 3 wherein a said interchangeable lid is substantially planar forming a covering for the open top.

7. The music instrument case of claim 3 further comprising a second attachment mechanism coupled to the main body and an attached said interchangeable lid.

8. The music instrument case of claim 7 wherein the second attachment mechanism comprises a first strap affixed to the main body and a second strap attached to the attached interchangeable lid, where the first strap and the second strap have snap buckles attached to free ends thereof.

9. The music instrument case of claim 3 wherein the main body is a wheeled container having wheels and an extendable handle attached thereto, with the wheels and the extendable handle attached to the main body on a bottom panel opposite the open top.

10. The music instrument case of claim 3 wherein the main body and a said interchangeable lid each include mating handles to allow for easy hand carrying.

11. The music instrument case of claim 3 wherein the main body has a shoulder strap attached thereto.

12. A configurable carrying case for transporting articles, the configurable carrying case comprising:

a main body forming an enclosure with an open top, the main body being structured so as to maintain its configuration and support the articles being transported, the main body further having a first portion of an attachment mechanism attached thereto at a location adjacent the open top;

a plurality of interchangeable lids, each lid sized and configured to cover the open top, each of the interchangeable lids further having a second portion of the attachment mechanism attached thereto, wherein the second portion of the attachment mechanism is configured to cooperate with the first portion thereby to allow for the removable attachment of one of the plurality of interchangeable lids to allow interchanging of the lids; and a set of mateable handle members, one attached to the main body and the remainder each respectively attached to one of the interchangeable lids for hand carrying the configurable case.

13. The configurable carrying case of claim 12 wherein the main body contains supporting structures to closely contain a musical instrument.

14. The configurable carrying case of claim 13 wherein the main body comprises a supporting structure is configured to contain a plurality of musical instruments.

15. The configurable carrying case of claim 12 further comprising a second attachment mechanism coupled to the main body and each interchangeable lid, wherein the second attachment mechanism comprises a first strap affixed to the main body and a second strap attached to a respective interchangeable lid, where the first strap and the second strap have snap buckles attached to free ends thereof.

16. The configurable carrying case of claim 12 wherein a said interchangeable lid includes an accommodation configured to receive portions of the articles which are anticipated to extend beyond the open top.

17. The configurable carrying case of claim 12 wherein a said interchangeable lid has additional compartments capable of carrying accessories.

18. A configurable musical instrument carrying case capable of being adapted to carry differing sets of instruments and accessories, comprising:

a main body forming a carrying chamber with an open top, the main body having a first portion of a first attachment mechanism attached thereto at an upper edge thereof adjacent to the open top and a first portion of a second attachment mechanism attached to a side surface thereof;

an instrument supporting structure specifically configured to receive and carry at least one at least one instrument in a manner that will cause the instruments to be held in a relatively constant position within the carrying chamber;

a plurality of interchangeable lids, with each lid sized to cover the open top, each of the interchangeable lids further having a second portion of the first attachment mechanism attached to a portion thereof, wherein the first portion and the second portion of the attachment mechanisms are configured to interact with one another to cause the interchangeable lids to be removably attached to the main body to allow interchanging of the lids while also allowing for reopening of the case, wherein each interchangeable lid further has a second portion of the second attachment mechanism attached thereto where the first portion and the second portion of the second attachment mechanism are removably coupled to one another to create a second level of attachment; and a set of mateable handle members, one attached to the main body and the remainder each respectively attached to one of the interchangeable lids for hand carrying the configurable case.

19. The configurable musical instrument carrying case of claim 18 wherein the first attachment mechanism is a zipper, and the second attachment mechanism is a pair of buckled straps.

* * * * *